US005910763A

United States Patent [19]

Flanagan

[11] Patent Number: 5,910,763

[45] Date of Patent: Jun. 8, 1999

[54] AREA WARNING SYSTEM FOR EARTHQUAKES AND OTHER NATURAL DISASTERS

[76] Inventor: John Flanagan, 160 Sequoia Ave., Carlsbad, Calif. 92008

[21] Appl. No.: 08/802,448

[22] Filed: Feb. 18, 1997

[51] Int. Cl.[6] ..... G08B 9/00

[52] U.S. Cl. ..... 340/286.02; 340/690; 364/421

[58] Field of Search ..... 340/286.2, 690, 340/540; 324/323, 344, 345; 364/421; 73/654

[56] References Cited

U.S. PATENT DOCUMENTS

| | | | |
|---|---|---|---|
| 4,066,992 | 1/1978 | Buller et al. | 340/690 |
| 4,408,196 | 10/1983 | Freeman | 340/690 |
| 4,649,524 | 3/1987 | Vance | 340/690 |
| 4,841,287 | 6/1989 | Flig et al. | 340/690 |
| 5,420,380 | 5/1995 | Harben et al. | 340/690 |
| 5,436,610 | 7/1995 | Ballesty et al. | 340/286.02 |
| 5,490,062 | 2/1996 | Leach et al. | 364/421 |

*Primary Examiner*—Jeffery A. Hofsass
*Assistant Examiner*—John Tweel, Jr.
*Attorney, Agent, or Firm*—Leonard Tachner

[57] ABSTRACT

A system that provides an area warning to a specific general population of an earthquake prior to the arrival of the hazardous ground motion typically associated with earthquakes, and of approaching natural disasters that could impact an area. This area advanced warning thereby provides time for users to seek shelter and through automated means to reduce property damage as well as injuries and lives lost. A preferred embodiment of the invention described herein utilizes a plurality of Local Station Detector Sites, equipped with earthquake seismic motion detectors and microprocessors designed to almost instantaneously provide a profile of existing ground motion to a Central Processing Site in conjunction with further analysis of similar signals from multiple sites. A warning instruction is then transmitted back to all appropriate Local Station Detector Sites to initiate transmission of local area warnings to a general population of all users in an appropriate and specific geographic area with minimal possibility of false alarms. Additionally all Local Station Detector Sites are equipped to receive notification transmissions from the Central Processing Site, which have been initiated by Public Safety Offices for other natural disasters, and transmit appropriate warning signals to the general population of users in specific geographic areas.

9 Claims, 12 Drawing Sheets

BLOCK DIAGRAM OF CENTRAL PROCESSING SITE SYSTEM

Flow Chart of the Invention

TO FIG. 17B

AREA WARNING SYSTEM FOR EARTHQUAKES AND OTHER NATURAL DISASTERS

BACKGROUND OF THE INVENTION

1. Field of the Invention

This invention relates to a system that provides an area warning of an earthquake prior to the arrival of the hazardous ground motion typically associated with earthquakes and of approaching natural disasters that could impact an area. This advanced warning provides time for users to seek shelter and through automated means to reduce property damage as well as injuries and lives lost.

2. Prior Art

An earthquake or other natural disaster such as fires, floods and tornadoes, as presently experienced in regions around the world and throughout all of mankind's history, have not been preceded by any type of advanced specific area warning that could help general populations avoid damage to lives or property. In the past, natural disasters such as fires, floods, tornadoes and hurricanes were sometimes preceded by general warnings of various types that could allow people time to seek shelter or otherwise protect themselves and their property, but the warnings were very general in nature and were transmitted to widely spaced geographic areas with little or no specific information as to the actual area to be impacted. These general warnings also required receiving devices that were in a ready state and to which the users were receptive in order to take some limited form of damage or injury avoidance.

Attempts in the past by recognized experts, to predict or warn of earthquakes have been widely regarded as futile. There was no recognized way to provide reliable advanced warning to a general population in an appropriately specific area of an impending earthquake prior to the strong ground movement normally associated with an earthquake.

Earthquakes are produced by the movement (fault rupture) of earth deep underground caused by a sudden release of accumulated strain energy. The accumulated strain energy is created by continuous deformation of blocks of earth moving in different directions over a long period of time. This sudden release of energy is caused when the two opposing blocks of earth exceed their elastic abilities. This ground movement (slippage) deep in the earth is radiated to the surface in the form of seismic waves. The site of an earthquake is called the focus and the point on the surface directly above the focus is called the epicenter.

The mechanical properties of the earth that seismic waves travel through, quickly organize the waves into two principal types for these purposes. Compression waves, know as primary or "P" waves travel fastest through the earth's crust. Shear waves, also known as secondary or "S" waves, travel more slowly, at about 60% of the speed of "P" waves.

The "S" waves are the waves which cause the shaking ground surface that is typically associated with earthquakes. The "P" waves are usually undetectable by human senses or are merely felt as an initial jolt, but are easily detectable with common devices currently in widespread use today. Both types of waves are routinely detected and recorded by various types of sensors.

Although wave speeds through the earth vary widely with the type of composition, the ratio between the average speed of a "P" wave and its following "S" wave is quite constant. This fact enables commonly used sensors (seismographs, motion detectors, and accelerometers) to map precise locations and relative magnitudes of the strain releases known as earthquakes around the world. These instruments normally detect both "P" waves and "S" waves and are used almost exclusively for retrospective analysis of earthquakes.

Some efforts have been made to utilize existing capability to provide limited warning of an impending earthquake. All previous efforts either fail to provide an appropriate area early warning signal to a general population and concurrent activation of various ancillary safety devices, or fail to reliably detect the earthquake "P" waves that can give the maximum advance warning necessary for general populations to take proper precautions.

The bulk of a general population in high population density areas, would not benefit from existing efforts or existing types of detection products. "P" Wave detectors with audible alarms rely exclusively on human reactions with very small lead time warnings for those closest to the heaviest damage and most in need of advance warning. "P" Wave detectors and warning systems placed in home or public buildings also require on-going maintenance, are subject to random damage and failure, and fail to provide proper relief from false positive warnings. There has been no recognized, reliable method to warn a general population in a specific area of an impending earthquake prior to the ground movement normally associated with an earthquake.

The following U.S. patents are relevant to this process:

| | | | |
|---|---|---|---|
| 5,200,735 | 5,184,889 | 5,142,499 | 5,075,857 |
| 5,101,195 | 5,078,172 | 5,019,803 | 5,001,682 |
| 5,001,466 | 4,998,601 | 4,908,803 | 4,978,948 |
| 4,956,875 | 4,841,287 | 4,815,044 | 4,789,922 |
| 4,764,762 | 4,764,761 | 4,649,524 | 4,607,376 |
| 4,594,582 | 4,484,186 | 4,359,722 | 4,330,103 |
| 4,297,690 | 4,296,496 | 4,296,485 | 4,269,011 |
| 4,166,344 | 4,086,504 | 3,949,300 | 3,886,494 |
| 3,866,121 | 3,865,990 | 3,864,674 | 3,742,478 |
| 3,739,283 | 3,636,452 | | |

Additionally, there are reported to be several commercially available products that attempt to detect earthquake "P" waves and sound an audible alarm. These products fall short of the present invention since their ability to warn of an earthquake is severely limited in time and scope. Waiting for earthquake "P" waves to arrive before sounding an alarm, severely limits the time available for the user and automated ancillary devices to take protective action and minimizes the usefulness of those devices.

None of the aforementioned prior art, or any other prior art known to the applicant, discloses an earthquake early warning system utilizing a large regional array of closely spaced detectors, real time signal processing at each local detector station site, a Central Processing Site to provide sophisticated real time and constantly upgraded warnings specifically to general populations of specific geographic areas that need to be warned. Further, no prior art utilizes the electromagnetic spectrum to issue a warning signal to a specific area general population as well as ancillary automated receiving devices for a general population in that area. Furthermore, no prior art known to the applicant provides a maximum interval of time between the warning and the arrival of damaging earthquake "S" waves. Furthermore, no prior art known to the applicant provides this type of specific area earthquake early warning to mobile users in a general population. Furthermore, no prior art known to the applicant provides directional real time, area earthquake early warning to a general population that is correlated with the location, intensity, and magnitude of the earthquake.

Some efforts have been made to utilize existing capability to provide limited warning of other types of impending natural disasters such as fires, floods, tornadoes or hurricanes. All previous efforts fail to provide an appropriate specific area early warning signal to a general population of inhabitants that are most likely to be affected. Further, they fail to provide concurrent activation of various ancillary safety devices or automated equipment and they fail to activate various types of warning devices that are in an inactive mode to give the maximum advance warning necessary for a general population to take proper precautions.

There are several types of commercially available emergency broadcast devices which are continually tuned to a specific frequency and designed to warn of a natural disaster that might affect a large scale geographic area. These systems transmit warnings to large scale geographic areas with boundaries far exceeding a projected area to actually be impacted by a natural disaster. The subsequent multiple "false alarms" to the majority population of users, reduces the warning effectiveness for the users. No prior art known to the applicant has the capability to reduce the geographic scale of the warning to only the general populations of those specific areas reasonably expected to be impacted by the impending natural disaster.

Further, no prior art known to the applicant is designed to transmit an area early warning signal for either earthquakes or other natural disasters to a plethora of receivers that can be activated by the signal if left in an inactive or off position by the users.

Described herein is a novel and advantageous area earthquake early warning system uniquely employing a plurality of earthquake ground motion sensors each equipped with preprogrammed microprocessors, spectrum analyzers, transmitters and receivers to detect, verify and warn of imminent danger from an earthquake to an appropriate specific geographic area with a general population of users. These warnings are timely and provide continually upgraded information on the status of the earthquake to system users to monitor real time information and modify actions of a general population or ancillary equipment based on that information.

System users employ a warning system signal microprocessor/receiver in a wide variety of devices and functions ranging from simple audible warning devices to sophisticated microprocessor/controllers for major systems such as transportation networks, power generation and distribution networks, and warning systems for schools, hospitals and other public buildings. Warning signal receivers may be incorporated into a very wide variety of existing or new devices such as smoke alarms, telephones, pagers, radios, televisions, computers, emergency lighting, elevators, traffic signals, utility systems and public address systems.

Additionally, this same area warning system enables appropriate warnings to be transmitted to a general population of system users in the event of such natural disasters such as fires, floods, hurricanes, tornadoes or other natural disasters. With these types of natural disasters, the area warning system relies on event detection and initial warning instructions from outside sources such as legally designated Public Safety Offices.

As a natural disaster occurs that threatens a specific area as determined by appropriate Public Safety Officials, a continuously transmitted signal is sent by that Public Safety Office 85 to the Central Processing Site (FIG. 13). The information transmitted by the Public Safety Office to the Central Processing Site 80 allows appropriate analysis of the event occurrence in terms of type of danger, direction, timing and other predetermined levels of public danger. Based on this analysis, the Central Processing Site then transmits warning alert signals to the appropriate Local Station Detector Sites which in turn, transmit an appropriate and continuously upgraded warning signal to system users in the specific geographically predetermined area of each Local Station Detector Site. With this system in place, only specific appropriate general populations in specific appropriate geographic areas are warned. This allows all system users in those general populations, a higher level of confidence in the nature of the warning as well as the severity, timing and type of danger that is imminent. This receipt of an advanced warning to a specific area that is likely to be impacted allows users more time to seek shelter, evacuate or take other appropriate actions and thereby reduces the chances of death, injury and property damages. Warning signal receivers would be of similar type and function as receivers used for earthquake warnings and would include but not be limited to smoke alarms, telephones, pagers, radios, televisions, computers, emergency lighting, elevators, traffic signals, utility lines and public address systems.

The continuously upgraded warning signals sent by the Local Station Detector Sites during both Earthquakes and other natural disasters are received by Microprocessor/Receivers which are also designed to be able to turn on power to devices left in an inactive mode, and then relay the warning signals to appropriate electromechanical controlling devices for performance of predetermined actions.

A preferred embodiment of the invention described herein utilizes a plurality of Local Station Detector Sites, equipped with earthquake seismic motion detectors and microprocessors designed to instantaneously provide a profile of existing ground motion to a Central Processing Site in conjunction with further analysis of similar signals from multiple sites. A warning instruction is then transmitted back to all appropriate Local Station Detector sites to initiate transmission of local area warnings to a general population of all users in an appropriate and specific geographic area with minimal possibility of false alarms. Additionally the Central Processing Site has the ability to send continuously upgraded warning signals for other types of disasters for receipt by each appropriate local station detector site. Each appropriate local station detector site then sends a continuously upgraded warning signal to each system user in its local area regarding the characteristics of the disaster. These warnings are initiated by appropriate Public Safety Offices and analyzed by the Central Processing Site for appropriate action.

Although it is contemplated that in preferred embodiments warning signals would be a form of radio frequency signal, virtually any form of radiant energy such as infrared, electromagnetic, light or acoustical energy may be utilized in other embodiments of the invention. Further, each geographic network may have multiple Central Processing Sites which provide immediate or simultaneous backup in the event of site failure for any reason.

The Local Station Detector sites or the Central Processing sites may be readily utilized alone or in conjunction with other sites such as telephone or utility distribution points, freeways road beds, or any other type of secured locations.

The receivers used by the invention to audibly warn users of an impending earthquake may be stationary or mobile. Stationary receivers include stand alone units, existing smoke alarms, radios, televisions or other types of alarm systems or public address systems. Examples of mobile receivers include those contained within a pocket pager, a cellular telephone, a car radio, or other such device.

Such receivers may also be equipped with means to activate various preprogrammed microprocessor equipped ancillary devices to further enhance the safety features of the invention. Examples are command and control of computers, elevators, lighting systems, electrical generation and transmission systems, transportation control systems, natural gas distribution systems and many other like uses.

OBJECTS OF THE INVENTION

Accordingly, several objects and advantages of the invention are:

A) To provide a means for an advance warning to an entire population of an appropriate geographic area that might otherwise suffer damage to property or injury and loss of lives from an earthquake or other natural disaster that has occurred, but is not yet felt.

B) To provide a means for increasing the warning time to an entire general population of an appropriate geographic area than would otherwise be available from any existing warning system using only a simple "P" wave detector connected to an audible alarm.

C) To provide a means for increasing the warning time an entire general population of an appropriate geographic area than would be otherwise available from any existing warning system using a simple "P" wave detector connected to an automated device.

D) To provide a means for increasing warning time to an entire general population of an appropriate geographic area than would be otherwise available from any existing warning system using a simple "S" wave detector and connected to an automated device.

E) To provide a means for advance warning to an entire general population of an appropriate geographic area for both mobile and stationary users at the time of an earthquake or other natural disasters.

F) To provide a means for advanced activation of automatic controls for various types of automated equipment such as elevators, gas main switches, computer systems, traffic and transportation control systems, municipal, electrical and emergency systems, and lighting and audible warning systems that might be damaged in the event of an earthquake or other natural disaster.

G) To provide a means for control and limiting of wide area false warning for earthquakes or other natural disasters for users of the system.

H) To provide a means for an area early warning that would be appropriate to the location intensity and magnitude level of an earthquake or other natural disaster with maximum warning for the general population in the appropriate area to be warned.

I) To provide a means for an early warning signal to an entire general population of an appropriate geographic area that would continually upgrade warnings to users as to the location, intensity and magnitude level of the earthquake or other natural disasters with warnings being constantly upgraded to maximize the usefulness of the signal appropriate for each user's specific needs.

J) To provide a means for an area warning of earthquakes or other natural disasters to multiple geographic areas appropriate to the location, intensity and magnitude level of an earthquake or other natural disasters without unnecessary warnings to areas not in danger of damage from those events.

K) To provide a means in the event of an earthquake or other natural disasters to activate audible alarms, or ancillary devices that are normally in an inactive mode, in order to receive warning signals and facilitate appropriate action by the users.

L) To provide a means for appropriate Public Safety Officials to initiate warnings of an impending natural disaster to an appropriate population of specific geographic areas that are reasonably expected to be impacted by the disaster.

M) Still another object is to provide a means to more quickly alert appropriate area emergency response systems and personnel of impending damages to allow appropriate actions to further minimize damages to property and minimize injury and loss of lives.

BRIEF DESCRIPTION OF THE DRAWINGS

The aforementioned objects and advantages of the present invention, as well as additional objects and advantages thereof, will be more fully understood hereinafter as a result of a detailed description of a preferred embodiment when taken in conjunction with the following drawings in which.

LIST OF REFERENCE NUMERALS

Figure 1:
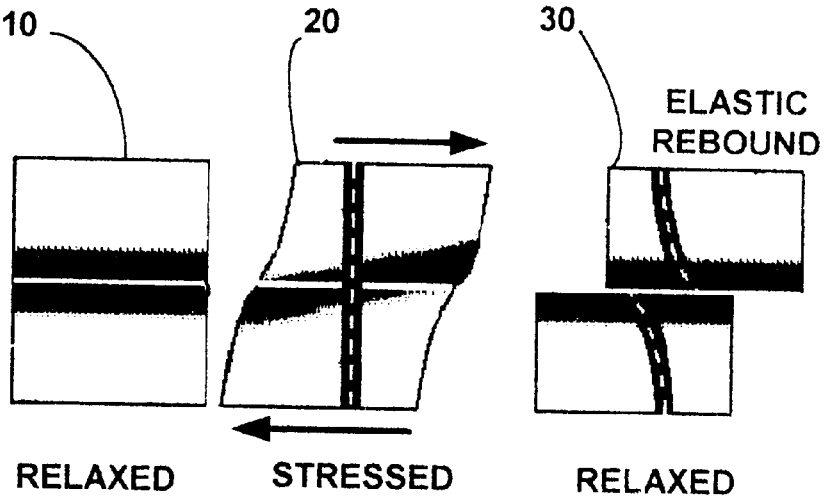
FIG. 1 illustrates the various stages in the earthquake cycle of seismic static deformation and elastic rebound.

10 Relaxed state of substratum earth.
15 Earthquake fault.
20 Stressed state of substratum earth before earthquake.
30 Relaxed state of substratum after earthquake and resulting deformation.
40 "P" wave.
45 Time differential between receipt of "P" wave and "S" wave.
50 "S" wave.
60 Local Station Detector Sites in "ready" state prior to receipt of "P" waves.
60A Initial Local Station Detector Site receiving and analyzing "P" waves.
60B Second Local Station Detector Site receiving and analyzing "P" waves.
60C Third and multiple other Local Station Detector Sites receiving and analyzing "P" waves.
61 "P" and "S" wave detector and real time microprocessor analysis unit in a Local Station Detector Site.
62 Local Station Detector Site alert signal transmitter to Central Processing Site.
63 Local Station Detector Site signal receiver from Central Processing Site.
64 Transmitter for sending continuously upgraded warning signals to appropriate surrounding area local system user receivers.
65 Triaxial Accelerometer and ground motion sensor.
66 Analog Digital Converter with multiplexed inputs.
67 Microprocessor System Controller.
70 Continuously upgraded alert signals from an initial Local Station Detector Site to a Central Processing Site.
71 Continuously upgraded alert signals from a second Local Station Detector Site to a Central Processing Site.
72 Continuously upgraded alert signals from a third or multiple other Local Station Detector Sites to a Central Processing Site.
80 A Central Processing Site.
81 A receiver for continuously upgraded alert signals from Local Station Detector Sites or from Public Safety Offices.
82 A transmitter for sending continuously upgraded instructions to Local Station Detector Sites.
83 Main Processing Site System computer and controller.
84 Main Neural network parallel processor with event archives.
85 A designated Public Safety Office such as fire headquarters, weather station, police station, etc.
90 A microprocessor/receiver for receiving continuously upgraded warning signals from Local Station Detector Sites for notification of the main controller mechanism of a system user device.
91 A microprocessor/receiver for receiving continuously upgraded warning signals from Local Station Detector Sites for activating electrical power to, and notification of, the main controller mechanism of a system user device.
94 An activating mechanism, on/off power switch, for the main controlling mechanism for a system user device.
95 A power source for the main controlling mechanism of a system user device.
96 The main controlling mechanism of a system user device.
99 The predetermined functions of a system user device.

DETAILED DESCRIPTION OF THE INVENTION

The preferred embodiments involve a combination of features that may be employed in an area earthquake and natural disaster early warning system. The following description is illustrative of only one utility of this invention and it will become apparent that the principles of the invention have wider applicability.

FIG. 1 illustrates the typical earthquake cycle as it progresses from a fault that is not under stress 10, to a stressed fault 20 as the plate tectonic motions driving the fault slowly proceed, to rupture during an earthquake and a newly relaxed 30 but deformed state. This seismic deformation and the sudden release of energy from the elastic rebound within the earth cause the dynamic motions of seismic waves commonly known as earthquakes.

Figure 2:
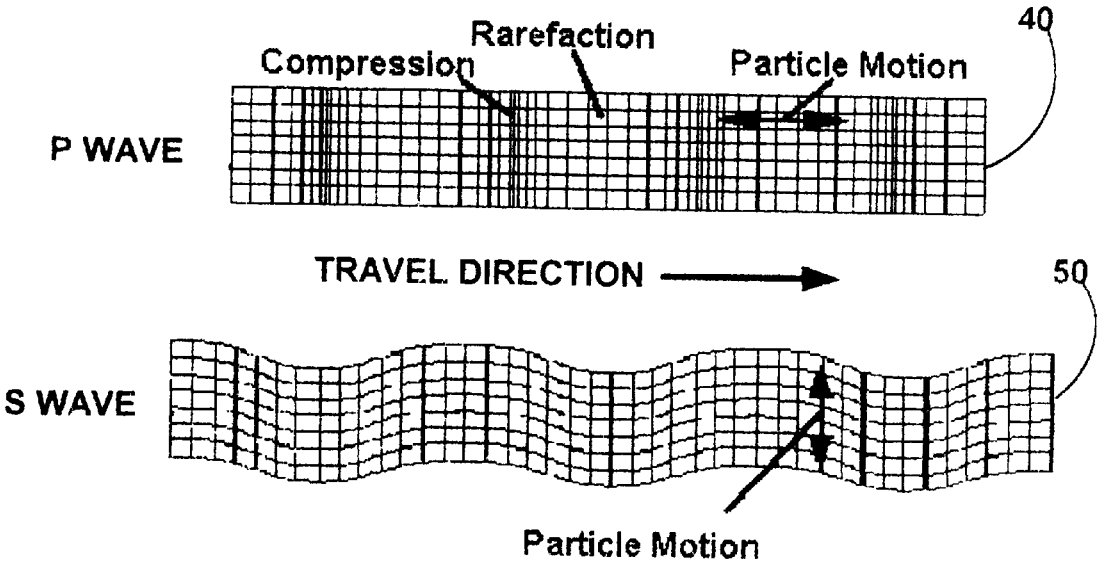
FIG. 2 illustrates two types of dynamic deformation motions known as "P" waves and "S" waves.

FIG. 2 illustrates how the mechanical properties of the rocks that seismic waves travel through, quickly organize the waves into two types. "P" waves 40 travel fastest, and "S" waves 50 generally travel at about 60% of the speed of "P" waves. "P" waves shake the ground in the direction they are propagating, while "S" waves shake perpendicularly or transverse to the direction of propagation.

Figure 3:
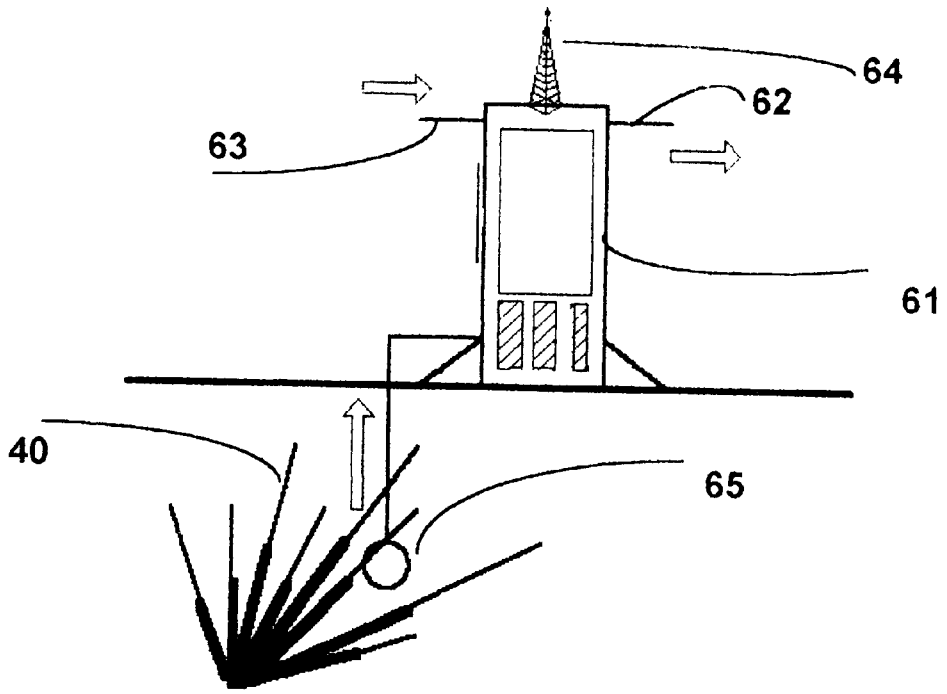
FIG. 3 is a drawing of a typical earthquake warning Local Station Detector Site equipped with seismic motion detector, preprogrammed microprocessor, and transmitting and receiving equipment.
Figure 11:
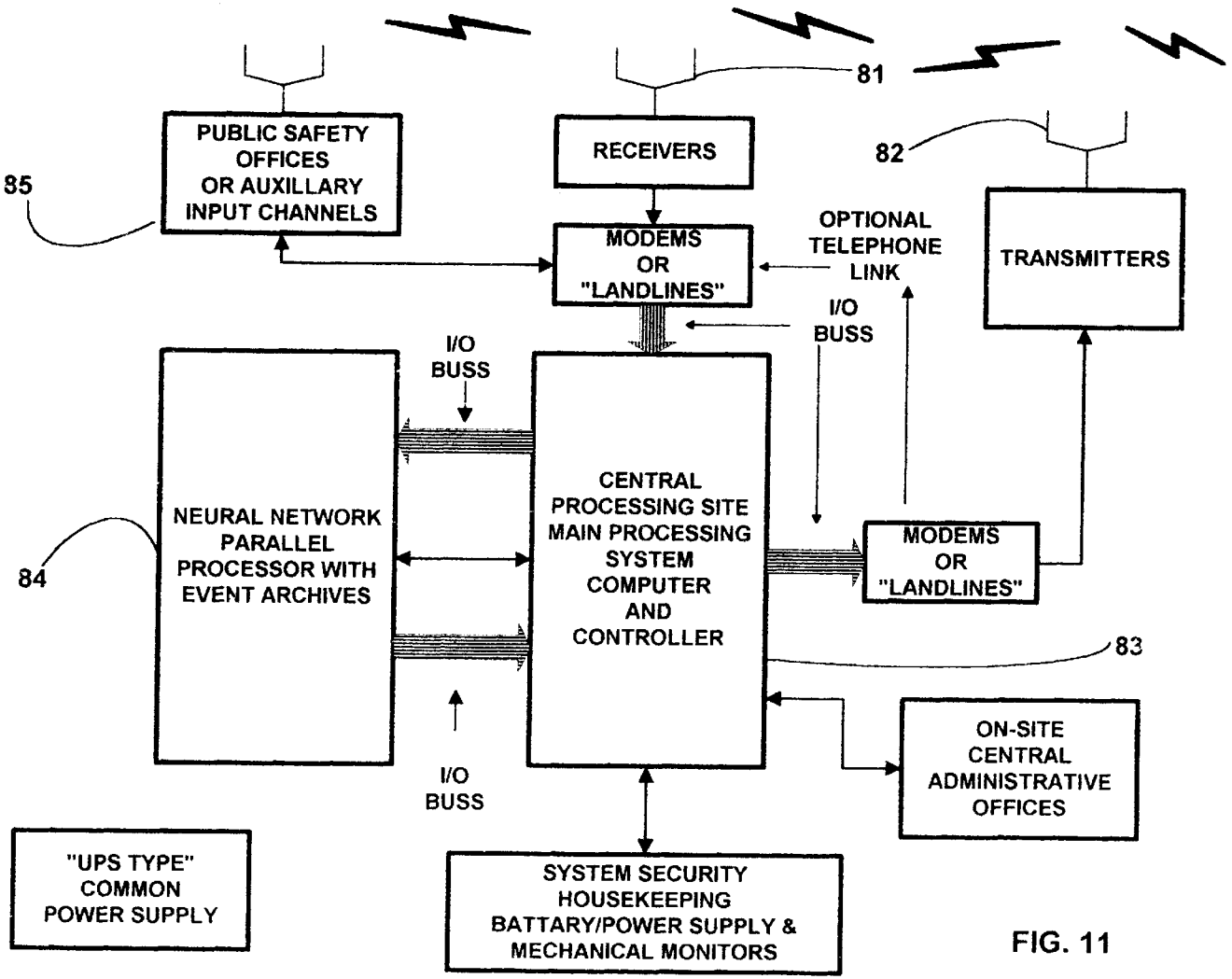
FIG. 11 is a block diagram of a Central Processing Site equipped with receiving and transmitting equipment, and programmed computers designed to provide real-time signal processing of continuous alert signals received from local station detector sites, or warning signals initiated from appropriate public safety offices, and continually determine the specific areas to warn, as well as the appropriate warning signal in accordance with the present invention.
Figure 17A:
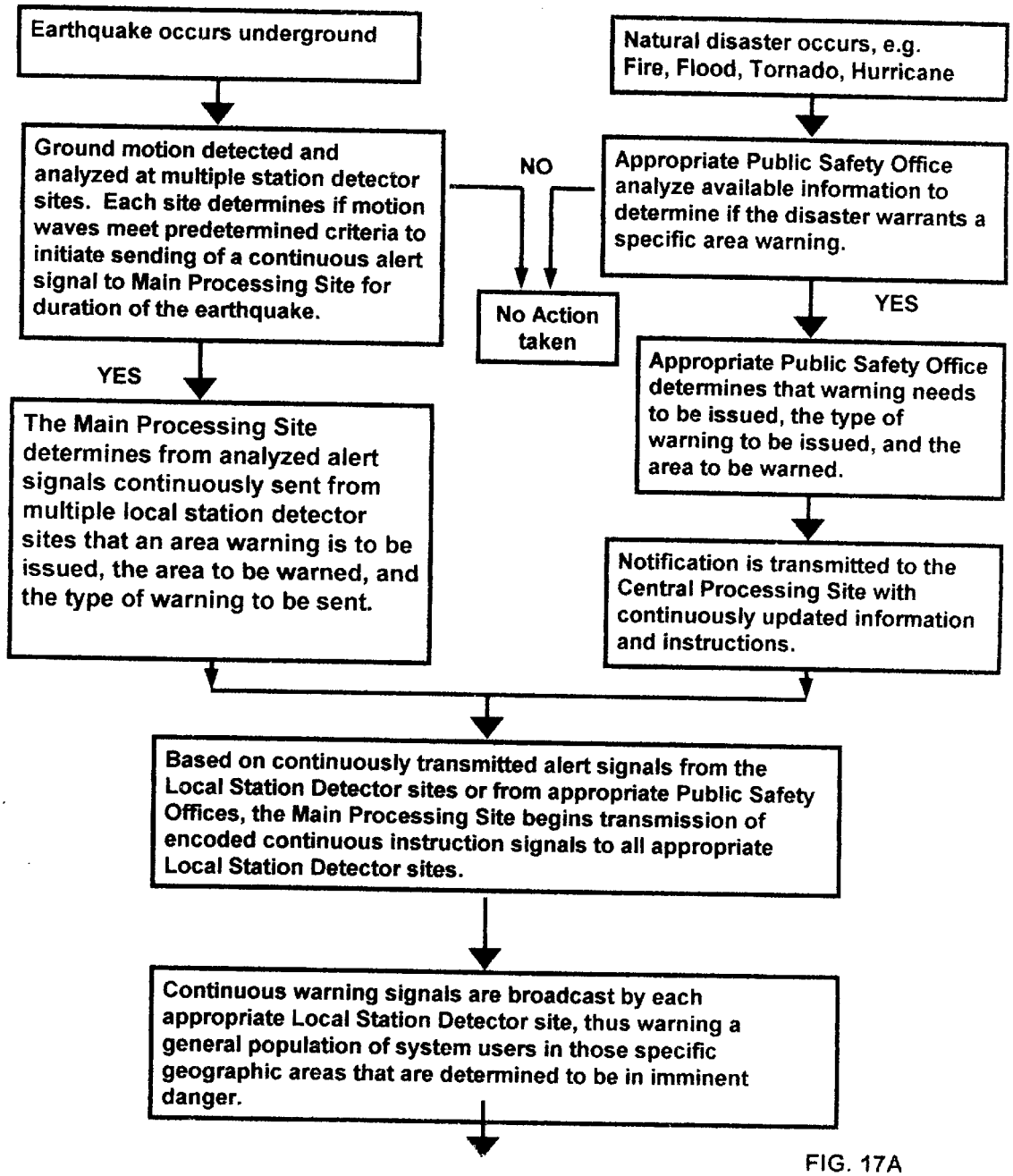
FIG. 17 comprising FIGS. 17*a* and 17*b,* is a flow chart drawing of the preferred embodiments of the invention.
Figure 17B:
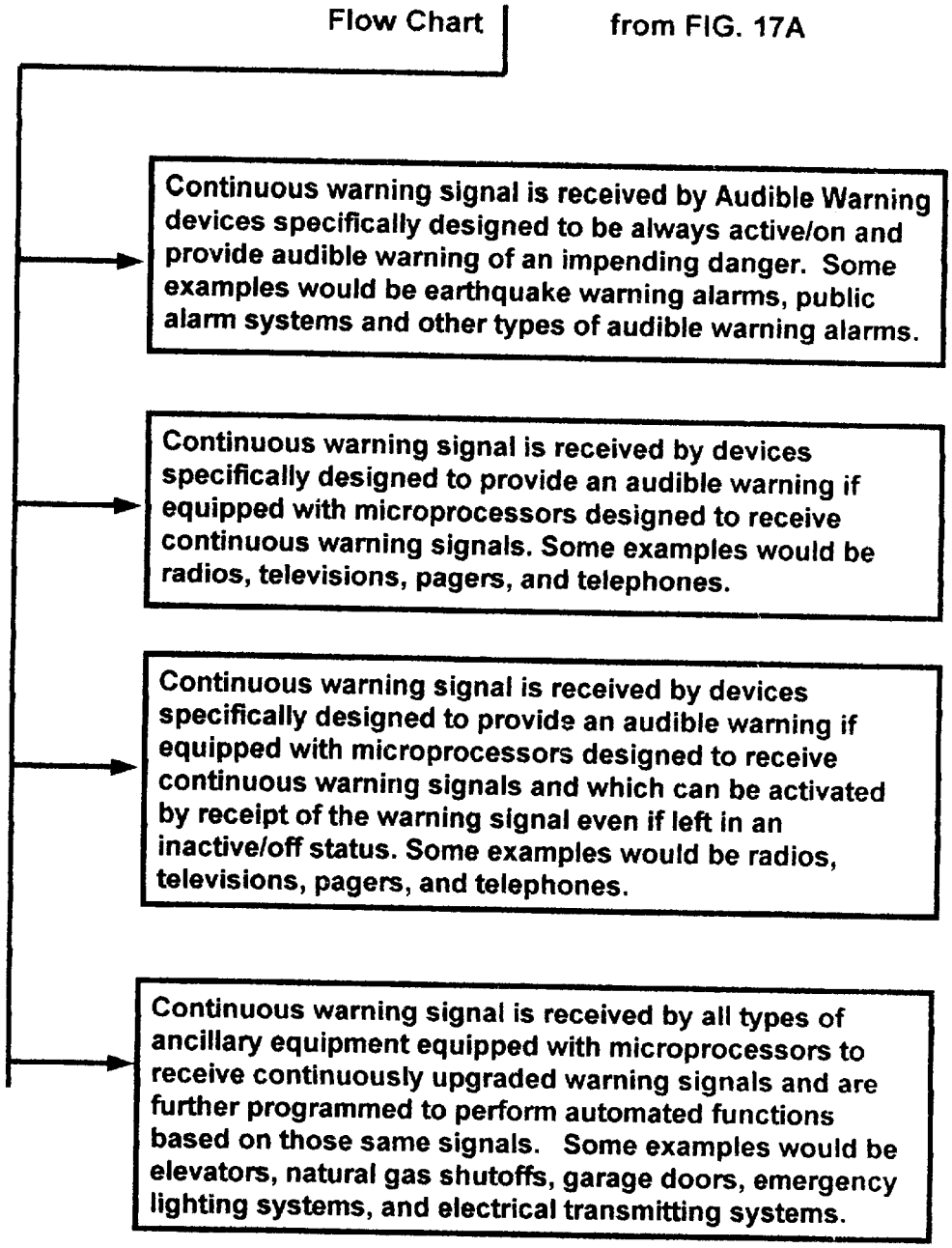

In FIG. 3, it will be seen that the main components of a Local Station Detector Site in accordance with the present invention. Earthquake "P" waves 40 arrive at means to sense and continuously analyze earthquake "P" waves 65, which then signals a radio alerting transmitter 62 to continuously transmit the analyzed and upgraded information of the impending earthquake by a transmitted signal to the Central Processing Site (FIG. 11). A radio receiver 63 receives further instructional transmissions from the Central Processing Site. The receiver awaits commands from the Central Processing Site to begin transmission of a continuously upgraded encoded warning signal through a transmitter 64 to all area earthquake warning system users within the predetermined range of the Local Station Detector Site transmitter. A block diagram view of a typical Local Station Detector Site is seen in FIGS. 17*a* and 17*b*.

Figure 4:
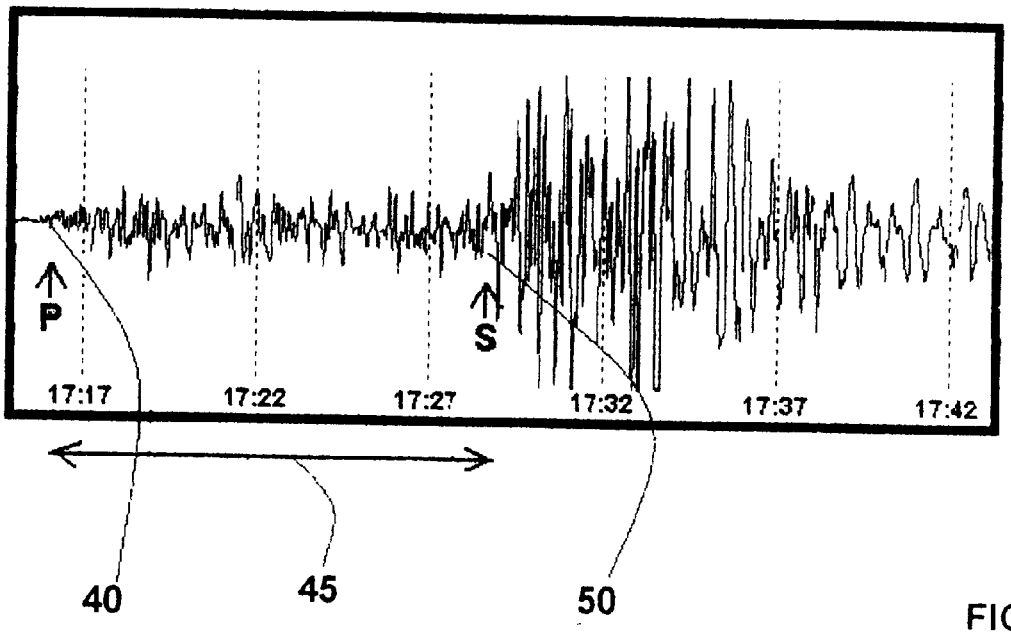
FIG. 4 illustrates a characteristic seismic tracing pattern of a "P" wave and "S" wave, with a time of receipt differential, in accordance with the present invention.

In FIG. 4, it will be seen that a seismographic trace of an earthquake in which the first detectable indicator of an earthquake 15 is the "P" waves 40 and that these "P" waves travel at a speed substantially greater than the more damaging "S" waves 50. The time differential of receipt of these two waves at this particular seismographic local station detector site is recorded as the time 45 between the receipt of the two waves. The time differential between the two waves is mostly a function of the distance of the recording station from the focus of the earthquake, and to a minor degree, the composition of the material composition of the earth they travel through.

Figure 5:
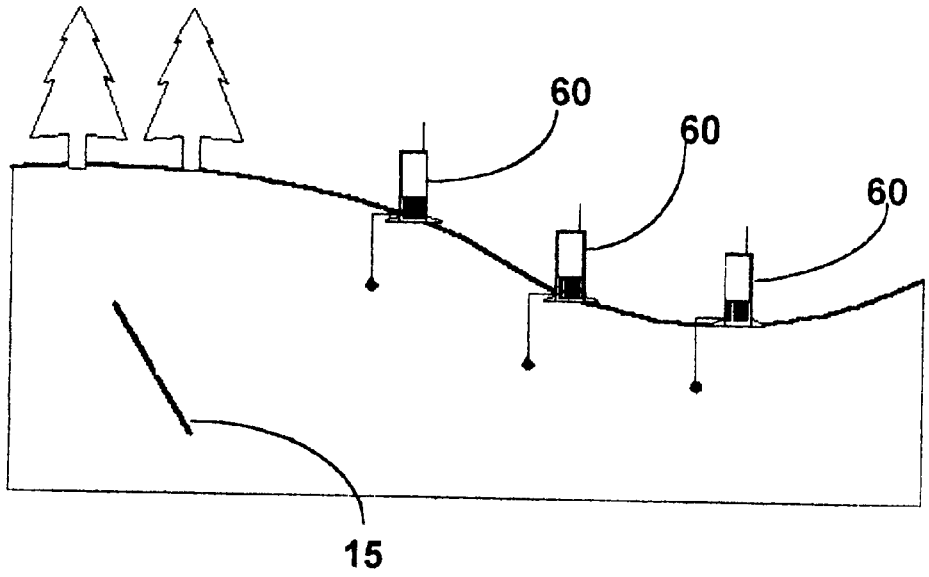
FIG. 5 is a cross sectional view of an earthquake fault line and the system local station detector sites, in accordance with the present invention.

FIG. 5 illustrates a cross sectional view showing an earthquake fault 15 that lies deep underground and the ground surface above the fault that is provided with a plurality of earthquake Local Station Detector Sites 60 in accordance with the present invention. Each Local Station Detector Site comprises means to detect and analyze earthquake "P" waves and "S" waves, a means to continuously analyze these waves, a radio transmitter to continuously transmit the analyzed information of the impending earthquake to the Central Processing Site (FIG. 11), as well as a radio receiver tuned to signals transmitted from the Central Processing Site to form a continuous information loop in accordance with the present invention.

Figure 6:
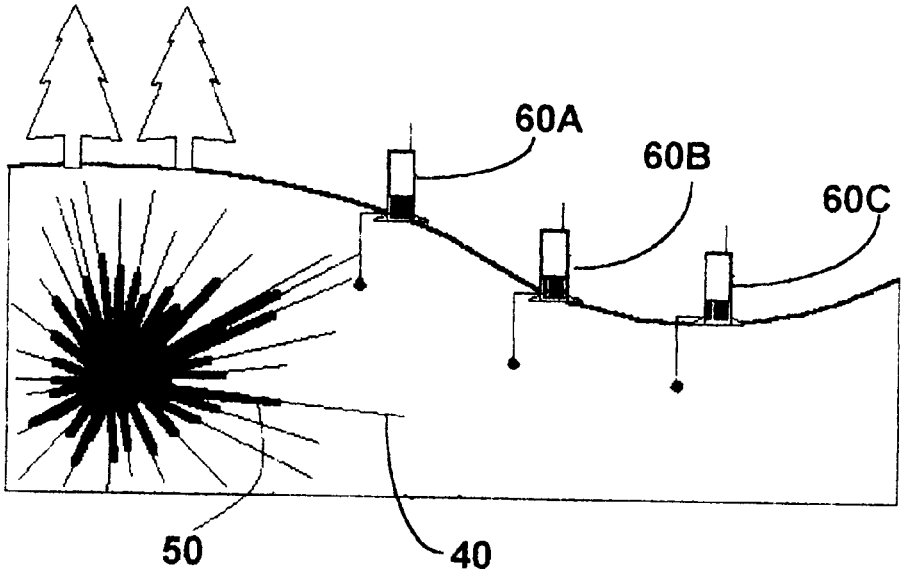
FIG. 6 shows a cross sectional view of earthquake "P" waves as they reach the first earthquake local station detector site, in accordance with the present invention.

In FIG. 6, it will be seen that an earthquake has just occurred deep underground and the earthquake "P" waves 40 have arrived at the first Local Station Detector Site 60A in accordance with the present invention, to soon be followed by the arrival of the earthquake "S" waves 50.

Figure 7:
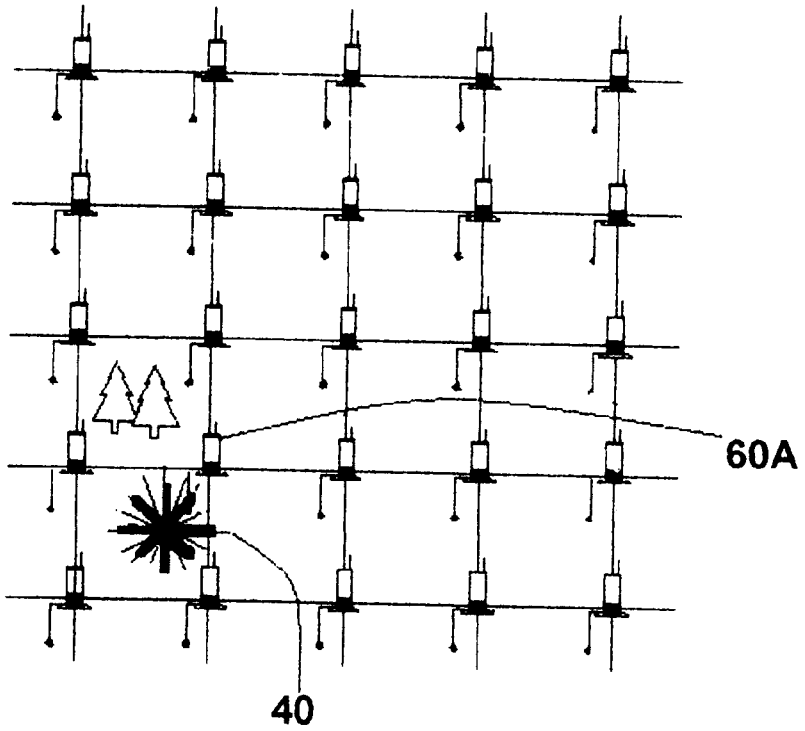
FIG. 7 shows a plan view corresponding to FIG. 6 where the earthquake "P" waves reach the first earthquake local station detector site, in accordance with the present invention.

In FIG. 7, it will be seen that there are a plurality of Local Station Detector Sites in accordance with the present invention in which the earthquake "P" waves 40 have arrived at the first local station detector site 60A, and soon are to be followed by the arrival of the earthquake "P" waves.

Figure 8:
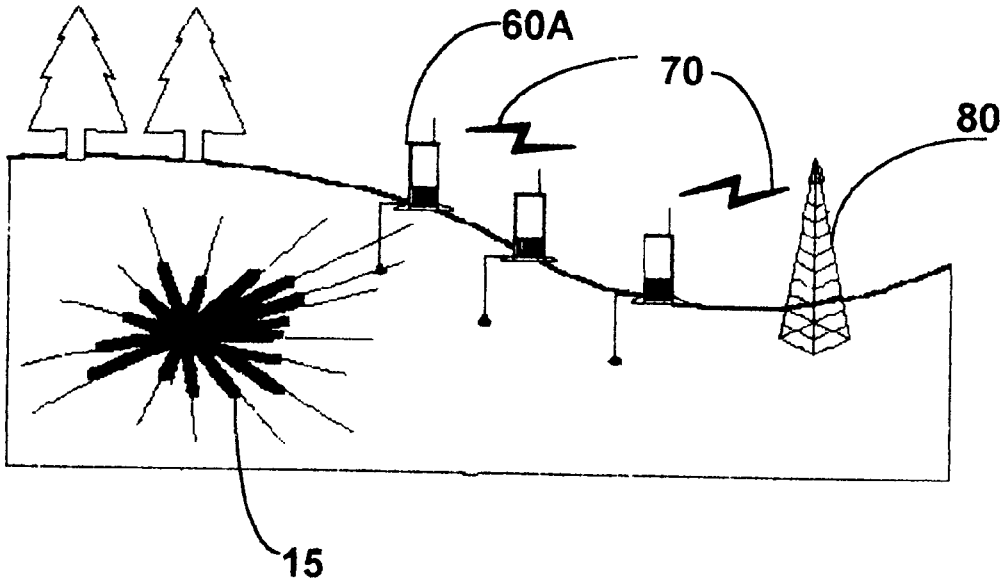
FIG. 8 illustrates a cross sectional view of the earthquake "P" waves and the earthquake local station detector sites as the initial alert signal is continuously issued to a Central Processing Site, in accordance with the present invention.

In FIG. 8 it will be seen that the initial Local Station Detector Site 60A has identified and analyzed the earthquake "P" waves and has issued the initial alert signal 70 to the Central Processing Site 80. This alert signal continues to be upgraded as the Local Station Detector Site microprocessor continues to analyze the ongoing earthquake in accordance with the present invention.

Figure 9:
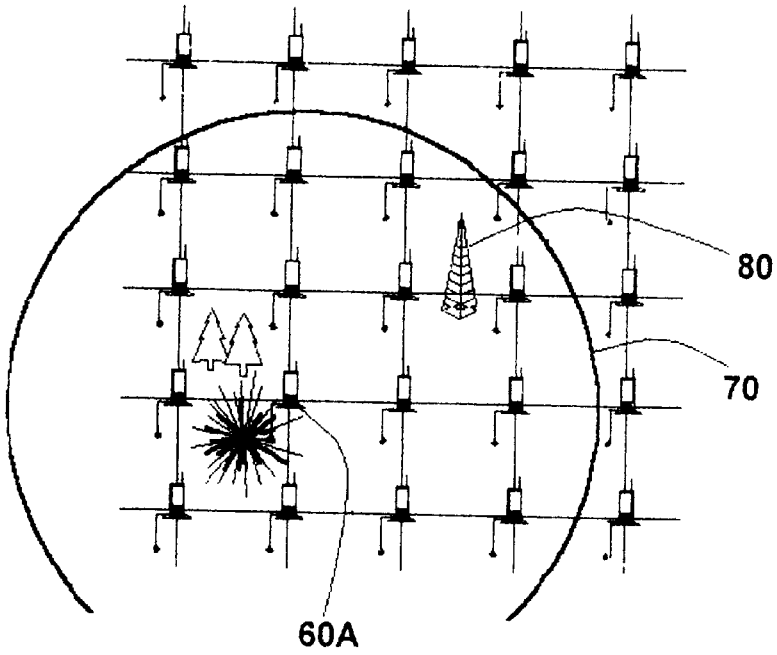
FIG. 9 illustrates a plan view corresponding to FIG. 8 showing the continuously issued alert signal from the first local station detector site transmitted to the (Central Processing Site, in accordance with the present invention.

In FIG. 9 it will be seen that the detector further locates and identifies the quake fault in accordance with the preferred embodiment of the present invention. The first earthquake Local Station Detector Site 60A has identified earthquake "P" waves that exceed specified predetermined criteria established by the Local Station Detector Site Analysis system. The Local Station Detector Site has begun to transmit a continuously upgraded alert signal 70 to the Central Processing Site 80 in accordance with the present invention.

Figure 10:
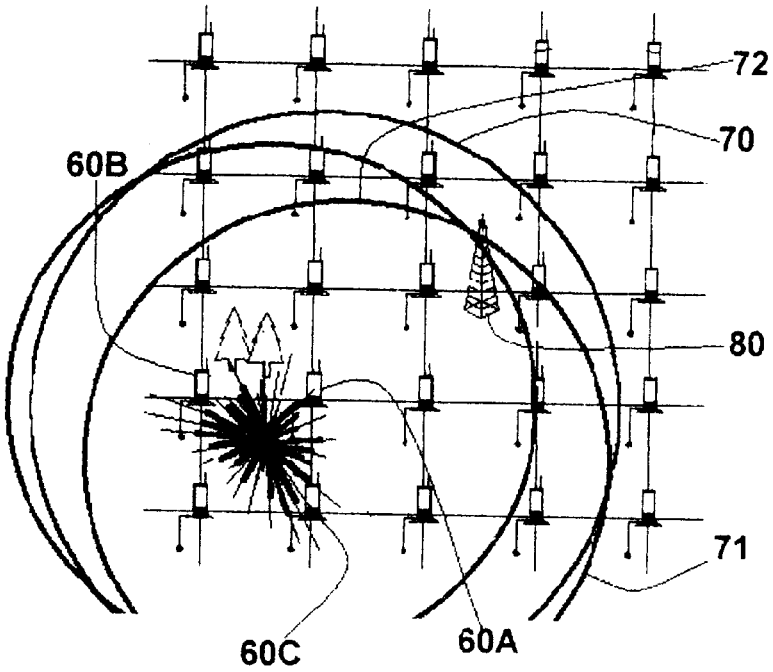
FIG. 10 shows a plan view of a Central Processing Site receiving continuous alert signals from three local station detector sites to illustrate the ability of the area earthquake warning signals to be continually upgraded with use of on-site microprocessors, neural network earthquake pattern analyzers and real-time signal processing in accordance with the present invention.

In FIG. 10 it will be seen that there are a plurality of Local Station Detector Sites in which Earthquake "P" waves have been detected and analyzed by three separate Local Station Detector Sites 60A, 60B and 60C. All three sites have begun transmission of alert signals 70, 71 and 72 to the Central Processing Site 80 for further analysis and possible transmission of an area earthquake warning signal to appropriate Local Station Detector Sites in accordance with the present invention.

FIG. 11 is a block diagram of the main components of a Central Processing Site in accordance with the present invention in which a receiver 81 obtains constantly upgraded information and alert warning signals about an ongoing earthquake from all local station detector sites that have exceeded predetermined threshold parameters. The Central Processing Site computer and controller 83 in concert with the neural network parallel processor with event archives 84, continuously analyze alert warning signal information from all Local Station Detector Sites. In the event of natural disasters such as fire, floods, tornadoes and hurricanes, the Central Processing Site also receives warning information from appropriate Public Safety Offices 85. A transmitter 82 is used to send constantly upgraded information and instructions back to the appropriate Local Station Detector Sites in accordance with the present invention.

Figure 12:
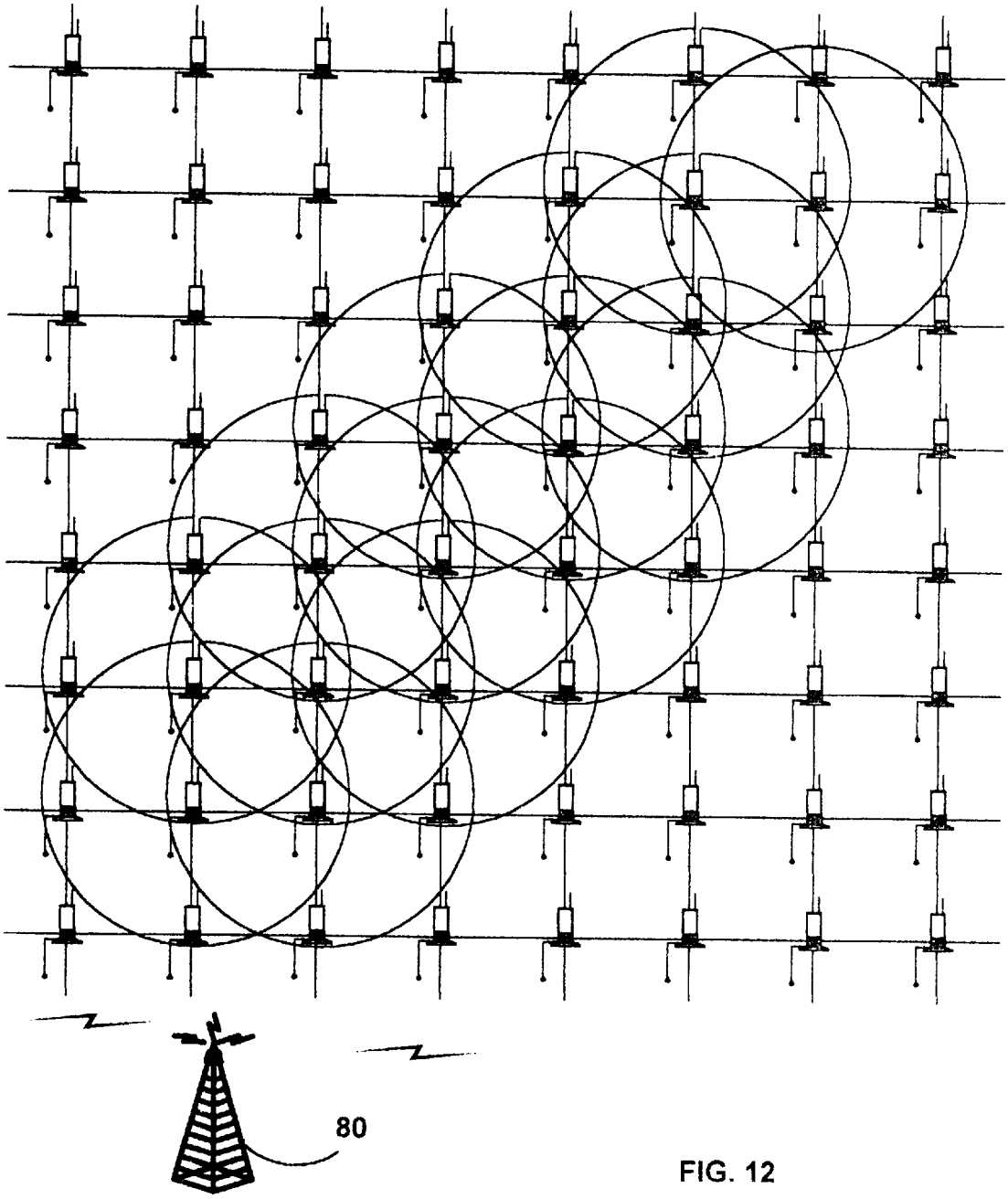
FIG. 12 shows a system scale plan view of the present invention illustrating continuously upgraded earthquake warning signals being sent to an appropriate area and a general population of system users from local station detector sites as instructed by the Central Processing Site in accordance with the present invention.

In FIG. 12, a system scale view will be seen with a plurality of Local Station Detector Sites and a Central Processing Site 80. The Central Processing Site is shown transmitting continuously upgraded information signals instructing appropriate Local Station Detector Sites to continuously transmit specific and upgraded warning signals (circles) or an impending earthquake to all system users in the area of each Local Station Detector Site in accordance with the present invention.

Figure 13:
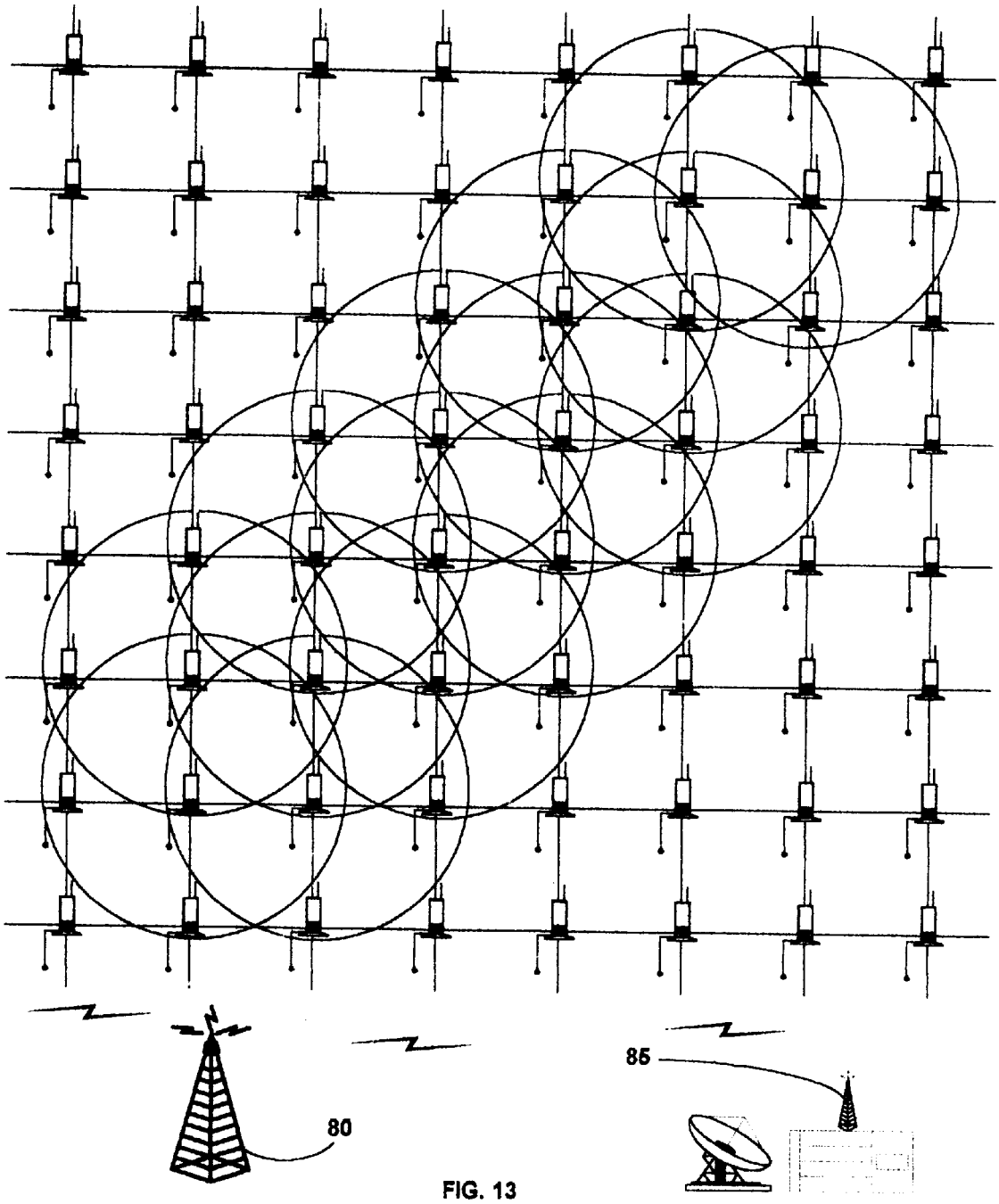
FIG. 13 illustrates a system scale view of the invention wherein appropriate Public Safety Officials have transmitted a request for a warning to be issued by the Central Processing Site to a specific geographic area of a natural disaster such as fire, flood, tornado, hurricane; and the Central Processing Site has issued a request to the appropriate local station detector sites to then issue an area warning signal in accordance with the present invention.

In FIG. 13 a system scale view will be seen with a typical Public Safety Office 85 issuing continuously upgraded alert warning instructions regarding an impending natural disaster to a Central Processing Site 80. The Central Processing Site is in turn, analyzing that information and transmitting continuously upgraded information signals instructing a plurality of appropriate Local Station Detector Sites to continuously transmit specific and upgraded warning signals (circles) regarding a natural disaster to all system users in the area of each Local Station Detector Site in accordance with the present invention.

Figure 14:
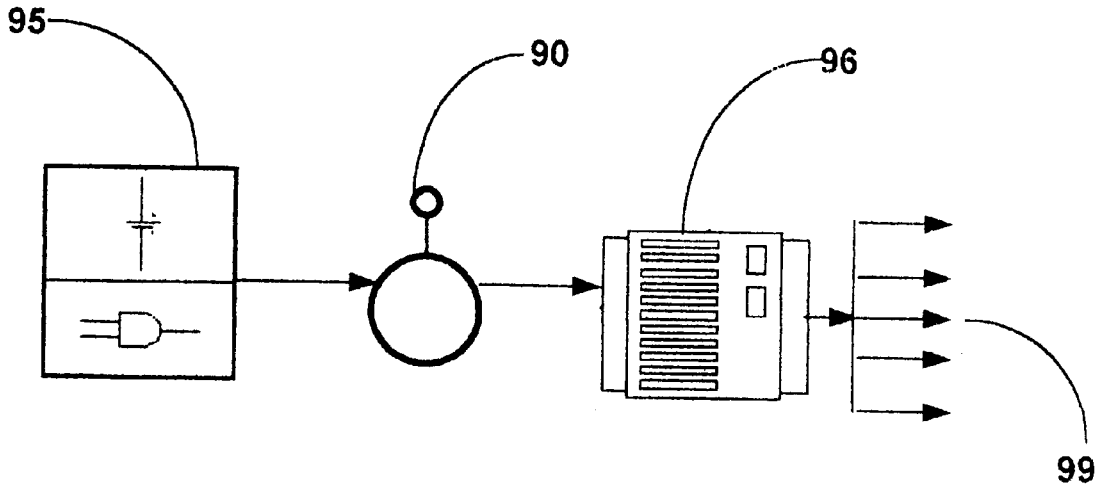
FIG. 14 is a block diagram of a typical audible warning or other ancillary controlling device that is always in an active state for receipt of warning signals, and that is microprocessor/receiver equipped to receive continuous warning signals from the local station detector sites and programmed to perform predetermined functions in accordance with the present invention.

In FIG. 14 there will be seen a block diagram of a typical device used to issue audible warnings or other types of predetermined instructions to ancillary devices. This type of device is always in an active mode to perform its predetermined tasks. The power source 95 furnishes electrical power through the system microprocessor controller 90 equipped with ability to receive continuously upgraded signals from the Local Station Detector Site and send predetermined instructions based on those signals to the main electromechanical controlling unit 96 of the device. The controlling unit then sends instructions which control predetermined functions 99 of the device in accordance with the present invention.

Figure 15:
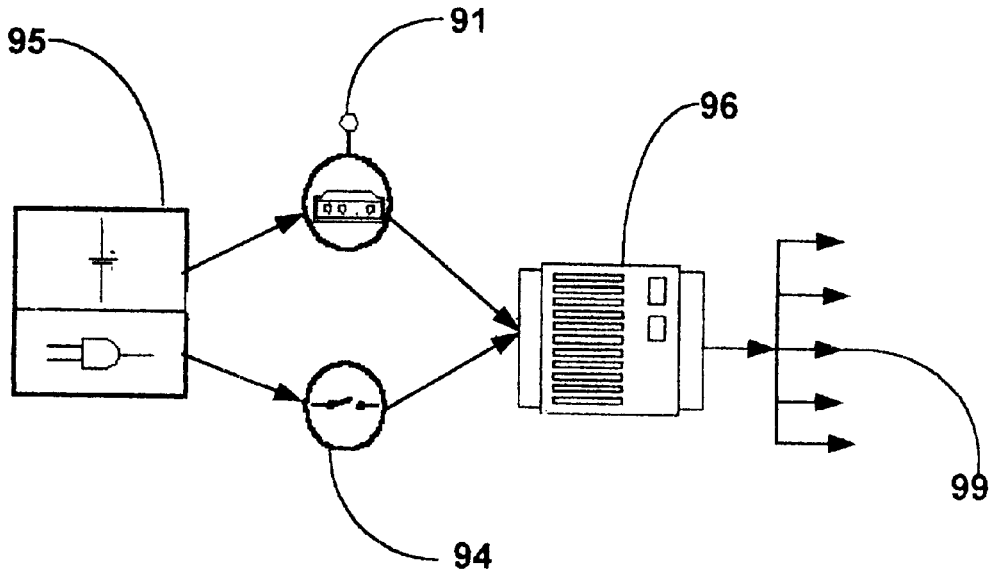
FIG. 15 shows a block diagram of a typical audible warning or other ancillary controlling device, that is normally activated by an on/off switch and is sometimes in an off condition, and that is microprocessor equipped to receive continuous warning signals from the local station detector sites and programmed to activate and turn on the device as well as perform predetermined functions in accordance with the present invention.

In FIG. 15 there will be seen a block diagram of a typical device used to issue audible warnings or other types of predetermined instructions to ancillary devices. This type of device is equipped with an on/off switch mechanism 94 to manually control the active status of the device and initiate performance of its predetermined tasks. The power source 95 can furnish electrical power through both the on/off mechanism 94 as well as through the system microprocessor controller 91. The system microprocessor controller is equipped with an ability to receive continuously upgraded signals from the Local Station Detector Site, activate power (turn on device), and send predetermined instructions based on those signals to the main electromechanical controlling unit 96 of the device. The controlling unit then sends instructions which control predetermined functions 99 of the device in accordance with the present invention.

Figure 16:
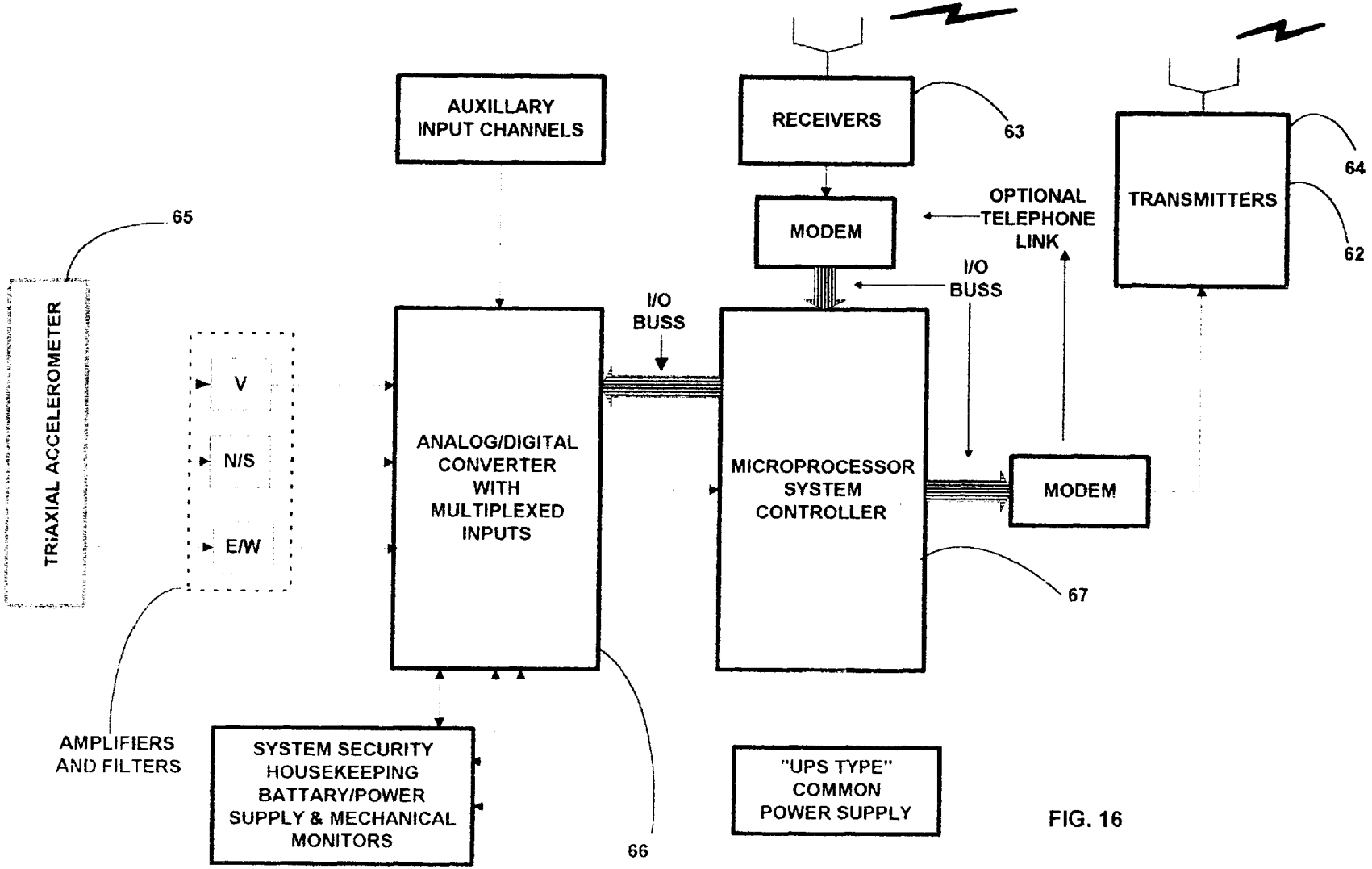
FIG. 16 is a block diagram of a typical Local Station Detector Site.

In FIG. 16 there will be seen a block diagram of the main components of a typical Local Station Detector Site in accordance with the present invention (shown in alternate view in FIG. 3) in which a ground movement sensor 65 detects and sends ground motion information to an analog/digital Signal converter 66. The digitized signals are continuously relayed to a microprocessor system controller 67 for immediate analysis. Continuously upgraded transmissions of ground movements at that site are sent to the system Main Processing Site by the transmitter 62. A receiver 63 continuously receives upgraded and encoded instructions from the Main Processing Site which may cause the transmission of an alert warning signal to all appropriate system user receivers within the predetermined area of the Local Station Detector Site by a transmitter 64 in accordance with the present invention.

FIGS. 17*a* and 17*b* provide a complete flow chart illustrating all aspects of the Area Warning System for Earthquakes and Natural Disasters in accordance with the present invention.

OPERATION OF THE INVENTION

As an earthquake occurs, deep underground, both "P" waves 40 and "S" waves 50 emanate from the fault rupture. The earthquake "P" waves travel at nearly twice the speed 45 of earthquake "S" waves (FIG. 4) and initially reach the earthquake Local Station Detector Site of the present invention that is in closest proximity to the focus of the earthquake 60A.

The first earthquake Local Station Detector Site 60A to receive ground motion from the earthquake begins a preprogrammed automatic continuous analysis of the movement. Each site (FIG. 3 and FIG. 16) is fully automatic and is equipped with readily available ground motion sensors 65 as a means for detection of "P" waves and "S" waves, or similar devices, along with analog/digital converters 66 and a standard microprocessor 67 equipped with neural network based software based upon historical data from a wide variety of recorded instances of earthquakes. This analysis system continually analyzes the ground movement to make an initial determination that an earthquake has occurred, and with further measurement, to determine an estimate of the earthquake location, intensity, and magnitude.

If the ground movement is determined by the local site to not be from an earthquake, that Local Station Detector Site takes no action. If the ground movement is determined by the local site to be from an earthquake and the initial parameters of the earthquakes' movement exceed predetermined criterion, then that site sends an alert signal 70 that is received by the System Central Processing Site 80 (FIG. 11) for further data analysis. Alert signals sent from each Local Station Detector Site to the Central Processing Site are continuously upgraded using signal packets transmitted as additional ground movement and analysis become available to each Local Station Detector Site. The Central Processing Site also checks continuously for the presence of similar alert signals from all other earthquake Local Station Detector Sites. Since this is, by definition, the first site closest to the epicenter, there can be no alert signal from other sites.

Subsequent earthquake Local Station Detector Sites 60B and 60C perform the same analysis. Every site detecting an earthquake exceeding the designated initial parameters, issues continuous alert signals 71 & 72 to the Central Processing Site. The Central Processing Site subsequently will receive alert signals from multiple other Local Station Detector Sites to confirm and continuously upgrade the informational quality as well as the validity of the alert signals front the initial site.

The Central Processing Site, continuously receives modified upgrade alert signals from all Local Station Detector Sites that have received ground motion from the earthquake. The receipt of continuously upgraded information from a plurality of sensing stations (FIGS. 8, 9 and 10), at various distances from the earthquake, allows the Central Processing Site to use its own decision making neural network based software and computers 84 & 83 to continually and automatically upgrade its analysis of the earthquake location, intensity, magnitude and other necessary data regarding the earthquake in real time.

The Central Processing Site, if warranted by the information received, and by the real time analysis of event location, intensity and magnitude, then determines the appropriate geographic and general population areas to be warned and begins transmission of a continuously upgraded instruction signal (FIG. 12) to all appropriate Local Station Detector Sites. In accordance with this invention, and as instructed by the Central Processing Site, all appropriate Local Station Detector Sites then begin transmission of a continuously upgraded warning signal to all system user receivers within the predetermined range and area of each Local Station Detector Site geographic area. The system user warning signal is transmitted only by the appropriate Local Station Detector Sites as determined by the Central Processing Site. The warning signals sent out by each Local Station Detector Site will continue to be upgraded as the nature and extent of the earthquake is analyzed and communicated by the Central Processing Site.

As shown in FIG. 12, initial warning and upgraded warnings are received by specific geographically appropriate users of the total system based on the results of sophisticated analysis by, and at the direction of the Central Processing Site. User applications and responses may range from simple audible warning alarms to warn of impending shaking, to sophisticated automated shutdown of energy and transportation systems. These widely different needs and responses can be accommodated by this warning system. As an earthquake event progresses, upgraded information is continuously received by the Central Processing Site from a multitude of Local Station Detector Sites. New upgraded information is encoded into the instruction warning signal sent back to the Local Station Detector Sites and then transmitted to system users. This upgraded information allows a higher quality of response by those system users so equipped with automated preprogrammed responses to the signal.

Preprogrammed automated responses by warning signal receivers can be modified by subsequent changes in the warning signal sent from the Local Station Detector Sites as the earthquake duration progresses and the real time analysis at each Local Station Detector Site is transmitted to the Central Processing Site for further analysis. This increased level, amount and quality of information allows a multitude of users with different response needs to modify automatic responses based on the real time analysis of event location, intensity and magnitude of the earthquake as the event progresses.

The Central Processing Site also serves to eliminate or greatly reduce the possibility of false alarms because of its ability to continually poll a widely spaced geographic area. This continuous polling ability and high level of data analysis also improve the informational quality of upgraded warning instructions to the appropriate Local Station Detector Sites.

Those having skill in the art to which the present invention pertains will now understand that there are many applications for the present invention. By way of example, the present invention may be readily used to warn of tornadoes, floods, hurricanes or fires by utilizing discretionary means to provide warning along the expected path but well ahead of the event focus.

The present invention has been described in sufficient detail to enable one skilled in the art to make and use the invention. Accordingly, specific details which are readily available in the art or otherwise conventional, such as the frequency of radio transmissions and the like have been omitted to prevent misunderstanding of the essential features of the invention. For example, the earthquake "P" wave or ground motion detector, although not specifically described, may be any one of a large number of conventional designs described in the literature and in common use in science and research.

Thus, it will be seen that the warning system described herein will result in a maximum of warning time available for a maximum general population in any specific appropriate geographic area. A plurality of closely spaced ground motion sensors are able to detect "P" waves as they first reach the ground surface greatly in advance of normally experienced "S" waves. The wave motion is analyzed in real time by an on-site microprocessor, transmitted almost instantly to a central analysis and processing station in real time for further analysis and comparison with known seismic patterns. Continuous transmissions from a multitude of subsequent additional local detector sites provide additional real time information and protection against false warnings. The complete system offers the ability for a maximum of warning time with a geographically specific continuous warning signal sent specifically to an entire general population of geographic areas that will soon be impacted by an earthquake that has occurred, but has not yet been felt by those inhabitants.

It will also be seen that the invention described herein provides a highly reliable means for an advanced area warning of an earthquake to a specific general population well in advance of damaging earth movement typically associated with earthquakes, as well as a highly effective warning for other types of natural disasters such as fires, floods, tornadoes and hurricanes. This advanced area warning will thereby provide time for a general population of users to seek shelter, and through automated means, to reduce damage to property and persons living in the affected areas.

It will also be seen that with this system in place only specific appropriate general populations in specific appropriate geographic areas are warned. This allows all system users in those general populations a higher level of confidence in the nature of the warning as well as the severity, timing, and type of danger that is imminent. This receipt of a high quality advance warning to a geographically specific area to be impacted, allows users more time to seek shelter, evacuate, or take other appropriate actions, and thereby reduces the chances of death, injury, and property damages.

Although this description contains exemplary details, these should not be construed as limiting the scope of the invention but as merely providing illustrations of some of the presently preferred embodiments thereof. Many variations are possible. In view of the foregoing it will be understood that the present invention may be implemented in a variety of alternative ways using a variety of alternative processing methods, but that all such implementations and processing methods are deemed to be within the scope of the present invention which is to be limited only by the claims appended hereto. Thus, the scope of the invention should be determined only by the appended claims and their equivalents.

I claim:

1. A wide area earthquake detection and general population advanced early warning system comprising:

a plurality of local station detector sites distributed as an array over a wide geographic area, each such site having:

a ground motion sensor having means for detecting earthquake generated "P" waves and subsequently received earthquake generated "S" waves;

an analyzer having means for determining the relative magnitude, intensity, and location, of an earthquake based upon receipt of said "P" waves and said "S" waves;

a transmitter having means for transmitting a signal indicative of said analyzer determined magnitude, intensity, and location to a central processing site;

a receiver having means for receiving signals from a central processing site; and a transmitter having means for transmitting advanced early warning signals to the entire local surrounding general population around each local station detector site of said earthquake;

a central processing site located at a selected position distinct from said array of local detection sites and having:

a receiver having means for receiving said signals from said array of local station detection devices;

a computer having means for calculating and analyzing the magnitude, intensity, location, and direction of travel, of said earthquake based upon said signals; and a transmitter having means for transmitting warning signals of said earthquake to selected local station detection sites; whereby each appropriate selected local station detector site as determined by the central processing site, will transmit advanced early warning signals specifically to those entire local surrounding general populations in a specific and targeted geographic area that are in imminent danger from an earthquake in progress.

2. The wide area earthquake detection and general population advanced early warning system recited in claim 1 further comprising a plurality of alarm devices having receivers dispersed among said entire general population and having means for receiving said warning signals for generating alarm responses among said entire general population to said earthquake.

3. The wide area earthquake detection and general population advanced early warning system recited in claim 2 further comprising a plurality of alarm devices having receivers dispersed among said entire general population wherein said alarm devices comprise a microprocessor controller having means for activating and deactivating selected electrical devices; whereby said electrical devices that have been left in an off position, are activated and turned on to allow receipt of said warning signals from the local station detector sites for generating alarm responses among said entire general population to said earthquake.

4. The wide area earthquake detection and general population advanced early warning system recited in claim 1 wherein each of said local station detection sites comprises a receiver having means for receiving said warning signals from said central processing site; and wherein each said local station detection site comprises a means for transmitting said warning signal to the entire local geographic area in proximity to each local station detection site; whereby the entire population of the selected specific geographic areas will receive advanced warning signals of said earthquake in progress.

5. The wide area earthquake detection and general population advanced early warning system recited in claim 1 wherein each said local station detection device comprises means for responding to each movement that meets a predetermined threshold criteria.

6. A wide area natural disaster detection and general population advanced early warning system comprising:

a plurality of local station detector sites distributed as an array over a wide geographic area, each such site having:

a receiver having means for receiving alert warning signals indicative of natural disasters from a central processing site, and a transmitter having means for transmitting advanced early warning signals to the entire local surrounding general population around each local station detector site of said natural disaster;

a central processing site located at a selected position distinct from said array of local station detection sites and having:

a receiver having means for receiving warning alert signals indicative of said natural disasters from selected public safety offices or any other available detection sources, a computer having means for calculating and analyzing the magnitude, intensity, location, and direction of travel, of said natural disasters based upon receipt of said warning alert signals, and a transmitter having means for transmitting warning signals of said natural disasters to selected local station detection sites; whereby each appropriate selected local station detector site as determined by the central processing site, will transmit advanced early warning signals specifically to those entire local surrounding general populations in a specific geographic area that is in imminent danger from a natural disaster.

7. The wide area natural disaster and general population advanced early warning system recited in claim 6 further comprising a plurality of alarm devices having receivers dispersed among said entire general population and having means for receiving said warning signals for generating alarm responses among said entire general population to said natural disasters.

8. The wide area natural disaster and general population advanced early warning system recited in claim 7 further comprising a plurality of alarm devices having receivers dispersed among said entire general population wherein said alarm devices comprise a microprocessor controller having means for activating and deactivating selected electrical devices; whereby said electrical devices that have been left in an off position, are activated and turned on to allow receipt of said warning signals from the local station detector sites for generating alarm responses among said entire general population to said natural disasters.

9. The wide area natural disaster and general population advanced early warning system recited in claim 6 wherein each of said local station detector sites comprises a receiver having means for receiving warning alert information from said central processing site: and wherein each said local station detector site comprises a means for transmitting said warning signal to the entire local geographic area in proximity to each local station detector site; whereby the entire population of the selected specific geographic areas will receive advanced warning signals of said natural disasters in progress.

* * * * *